US007556106B1

(12) United States Patent
Meinen et al.

(10) Patent No.: US 7,556,106 B1
(45) Date of Patent: Jul. 7, 2009

(54) DRILLING FLUID MONITOR

(76) Inventors: Lee O. Meinen, 1701 Plum St., Edingburg, TX (US) 78539-6342; Katherine Meinen, 1701 Plum St., Edinburg, TX (US) 78539-6342

( * ) Notice: Subject to any disclaimer, the term of this patent is extended or adjusted under 35 U.S.C. 154(b) by 117 days.

(21) Appl. No.: 11/656,300

(22) Filed: Jan. 22, 2007

(51) Int. Cl.
*E21B 21/01* (2006.01)

(52) U.S. Cl. ..... 175/66; 175/40; 175/207; 73/433; 73/152.19

(58) Field of Classification Search ..... 175/66, 175/40, 207; 73/433, 152.19; 177/254
See application file for complete search history.

(56) References Cited

U.S. PATENT DOCUMENTS 2,925,251 A * 2/1960 Arps ..... 175/39
3,031,891 A * 5/1962 Dower ..... 73/438
3,074,199 A * 1/1963 Johnson et al. ..... 43/129
3,602,322 A 8/1971 Gorsuch
3,911,741 A 10/1975 Rochon et al.
4,290,305 A 9/1981 Gibson et al.
4,412,917 A * 11/1983 Ahjopalo ..... 210/104
6,257,354 B1 7/2001 Schrader et al.
2003/0164235 A1 * 9/2003 Leeson et al. ..... 166/266

* cited by examiner

*Primary Examiner*—Shane Bomar

(57) ABSTRACT

A drilling fluid monitor system includes a pump fluidically connected to the drilling fluid to withdraw fluid from that system and move it to a scale that includes two coils through which the withdrawn fluid is circulated. The coils are positioned on a scale so the withdrawn fluid can be accurately weighed and returned to the drilling system via the pump.

2 Claims, 1 Drawing Sheet

DRILLING FLUID MONITOR

TECHNICAL FIELD OF THE INVENTION

The present invention relates to the general art of drilling, and to the particular field of drilling fluid monitoring.

BACKGROUND OF THE INVENTION

During the drilling of a well in the quest for hydrocarbons using the rotary method of drilling, it is necessary to pump or circulate a drilling fluid, known in the art as "drilling mud" downwardly through the drill pipe to which the drill bit is attached and outwardly through the drill bit into the annulus formed by the drill pipe and the wall of the well bore for return upwardly through the annulus to the surface.

A container known as a suction tank contains the drilling fluid for pumping through the drill pipe into the well. The circulating drilling mud exits from the drill bit returning to the surface through the annulus between the drill pipe and the wall of the well bore and out into a shaker box where the cuttings which are drilled up are separated from the returning drilling fluid. The drilling fluid then flows from the shaker box via a settling tank back to the suction tank for return to the well. The drilling mud is essential to a well drilling operation as it serves to carry away the cuttings from the drill bit to facilitate drilling and act as a medium for transporting the cuttings from the drill bit area out of the well bore to be separated from the mud via shaker or settled out in a mud pit at the top of the well prior to recirculation. The primary function of the drilling mud is to act as a stopper in the well by exerting hydrostatic pressure on the bottom of the well according to the specific weight of the drilling mud thereabove to balance or overcome the formation pressure in order to prevent blowouts. The pressure of the formation adjacent the drill bit, or bottom-hole pressure must also be taken into consideration because this pressure must be sufficient to sustain the hydrostatic pressure of the mud in order to prevent loss of circulation, that is the loss of the mud as it escapes into the formation due to the pressure exerted by the mud column being substantially greater than the formation pressure itself. It is therefore essential that the pressures in the well bore, i.e. the formation pressure and the hydrostatic pressure of the drilling mud be maintained near balanced condition. The drilling mud also acts as a sealing means on the well bore by caking on the surface of the bore to seal the bore and prevent the drilling mud from flowing out into porous formation material.

It is necessary that the drilling mud must be of sufficient weight to balance against the force of any upwardly acting hydrostatic pressure such as the pressure of gas, water, or oil which may be exposed in drilling and at the same time the drilling mud should not become so heavy that it enters the formation causing a loss of circulation. As conditions vary in the course of drilling, the weight of the drilling mud has to be varied constantly to meet these changing conditions. For instance, if the gas sand is penetrated the gas in the bore space will become a part of the drilling fluid. As the fluids are pumped out of the hole the gas expands, mud flows out of the hole at a faster rate than it enters and the mud weight becomes considerably lighter. Such a condition must be detected immediately as remedial action may be necessary by the addition of weight material to the drilling fluid otherwise the fluid might not contain the forces of the formation pressures reacting upwardly thereagainst with the consequence that a blowout may occur.

The use of excessive mud weight to provide a large factor of safety against blowouts was previously used as a standard drilling procedure. Of course, as mentioned previously, such an overbalance may result in a loss of circulation where the formation pressures are incapable of withstanding the overbalanced hydrostatic pressures of the drilling mud. For reasons of economy, a new drilling concept of balanced pressure drilling was adopted and it became essential that continual accurate measurement of the mud weight be maintained at all times during the drilling operation. Balanced drilling grew out of the need for more economy in the drilling operation, since less dense drilling mud allows faster drilling with less wear on the equipment. Since balanced pressure drilling reduced the factor of safety against blowouts which resulted from excess mud weight it becomes imperative that accurate and continuous mud weights into and out of the well be logged since the best evaluation of bottom hole conditions is to continuously determine the absence or to accurately measure the volume of gas entering the hole. Such a determination will provide information essential to maintaining minimum mud weight to balance the bottom hole pressures and prevent blowout conditions.

Mud weight, the key to well safety, is the most valuable information on the drilling well yet it has been the most neglected. There has never been a problem of knowing when there was a lot of gas since it could be detected by smelling, tasting and visual observation and the development of gas detecting equipment was directed to the identification of the sub-sensory or small amounts of gas. No appreciable progress was made in the measurement of large quantities of gas and the standard practice of checking mud weights today is the use of the hand balance device for periodic checks. Several types of continuous mud weighing devices have been developed, however, due to their limitations, it is estimated that only one well out of a hundred has a continuous mud weight device. The prior devices have consisted of mechanical and float devices with moving parts and pressure differential devices. Both the measurement of the "mud weight in" at the suction tank and the "mud weight out" of the shaker box has had its problems. The use of pneumatic tubes in the shaker box were affected by the excessive turbulence of the mud flowing into the shaker box and the box would fill with cuttings and stop up the tubes. In the suction tank on the mud discharge side, excessive changes in the level of the mud in the tank would leave the permanently placed pneumatic tubes out of the mud. Problems were also compounded by changes in submersion depths which affected the other properties of the mud such as the viscosity and gell strength.

It is recognized that a continuous accurate measure of the amount of gas entering the formation is valuable information for properly balancing a well during the drilling operation. Drilling for hydrocarbons is hazardous as evidenced by frequent blowouts which cause considerable air and water pollution and general ecological damage. Blowouts result from the unknown relationship between formation pressures and the weight of the drilling mud which is predetermined for formation pressure containment and penetration control. The mud weight determinations are initially based on historical data for a particular formation which of course is only an approximation and it is therefore essential that accurate and continuous determinations be made of the drilling fluid exiting from a well since the mud weight out of the well is a reflection of the bottom hole pressure relationship and the content of the formation being drilled up.

Many devices have been developed to give advance warning of potential trouble in the drilling of a well so that remedial action may be taken to minimize the trouble and control the well. The basic warning and indication of trouble is the relationship between the input drilling mud and the output drilling mud, i.e. the weight per unit volume and the volume per unit time of the mud at the entrance and at the exit from the well. If the volume of the returning drilling fluid is less than that of the input drilling fluid, the formation is taking the drilling fluids which is commonly referred to as a loss of circulation wherein the drilling mud enters the formation faster than it is pumped into the well. The sooner this condition is determined, the easier it is to seal off the zones that are taking the fluids. If more mud comes out of the hole than is pumped in, formation fluids such as salt water, gas or oil are entering the bore hole. When fluids enter the bore hole, mud containing pressures are inadequate since the fluid entering the hole will mix with the drilling mud being pumped into the well and lighten the weight of the mud column of the mixture being pumped out of the well. To make an accurate determination of the gas entering the formation, a new U-tube detector was invented for accurately and continuously measuring large quantities of gas entering the formation. This device, which measured the weight of the mud returning from the well bore prior to gas aeration at atmospheric pressure was difficult to set up and maintain.

SUMMARY OF THE INVENTION

The above-discussed disadvantages of the prior art are overcome by a drilling fluid monitor system that includes a pump fluidically connected to the drilling fluid to withdraw fluid from that system and move it to a scale that includes two coils through which the withdrawn fluid is circulated. The coils are positioned on a scale so the withdrawn fluid can be accurately weighed and returned to the drilling system via the pump.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 2:
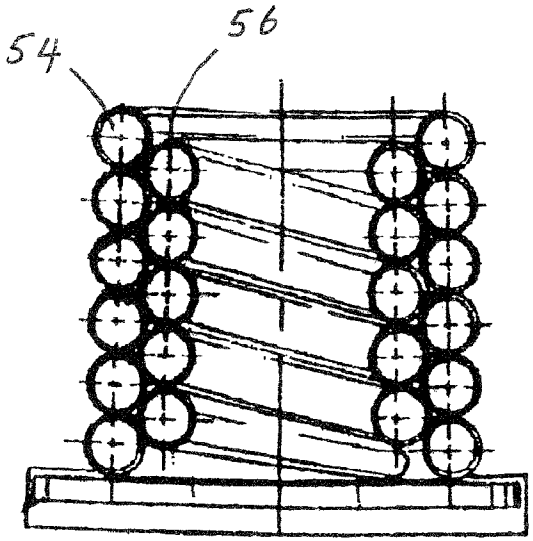
FIG. 2 is a sectional view taken along line A-A of FIG. 1.
Figure 3:
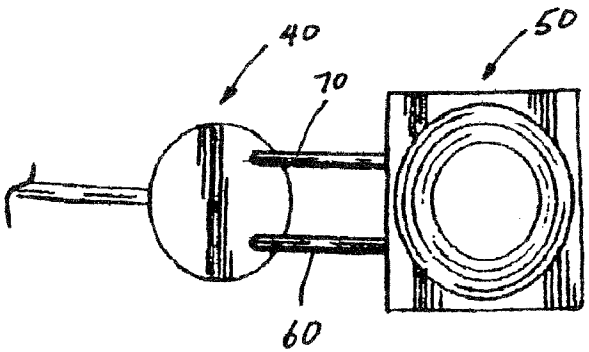
FIG. 3 is a top plan view of the system shown in FIG. 1.
Figure 1:
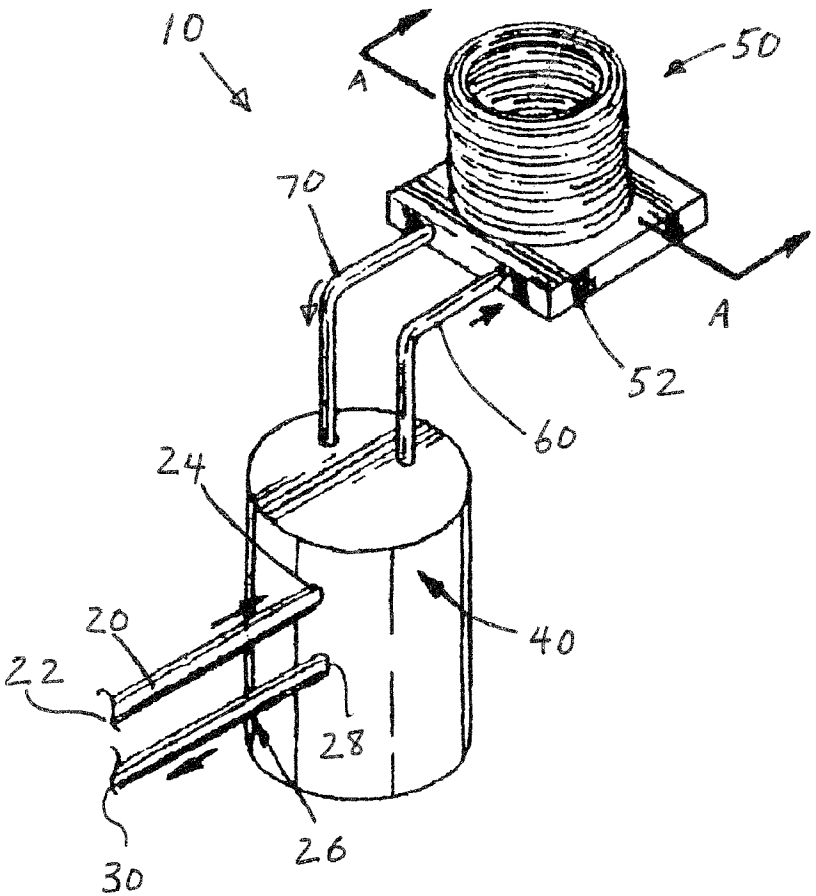
FIG. 1 is a perspective view of a drilling fluid weighing system embodying the present invention.

Referring to the figures, it can be understood that the present invention is embodied in a drilling fluid monitoring 10. System 10 comprises an inlet fluid conduit 20 having an inlet end 22 in fluid connection with a system being monitored and an outlet end 24 and a return fluid conduit 26 having an inlet end 28 and an outlet end 30 in fluid connection with the system being monitored. The system being monitored can be a drilling system or the like.

A fluid container 40 is in fluid connection with outlet end 24 of inlet fluid conduit 20 and with inlet end 28 of return fluid conduit 26 so that fluid flows into and out of the fluid container via the inlet fluid conduit an the return fluid conduit. A scale unit 50 includes a weighing scale 52 and a first fluid coil 54 and a second fluid coil 56 on the weighing scale. The fluid coils are in fluid communication with fluid container 40 so fluid flows through the fluid coils from and to the fluid container.

A first fluid connection conduit 60 fluidically connects the first fluid coil with inlet fluid conduit 20 and a second fluid connection conduit 70 fluidically connects the second fluid coil with return fluid conduit 26. Weighing scale 52 weighs fluid coils 54 and 56 with fluid contained therein to measure fluid characteristics of fluid being circulated through the fluid container.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A drilling fluid monitoring system comprising:

A) an inlet fluid conduit having an inlet end in fluid connection with a system being monitored and an outlet end;

B) a return fluid conduit having an inlet end and an outlet end in fluid connection with the system being monitored;

C) a fluid container in fluid connection with the outlet end of the inlet fluid conduit and with the inlet end of the return fluid conduit so that fluid flows into and out of the fluid container via the inlet fluid conduit and the return fluid conduit;

D) a scale unit which includes (1) a weighing scale, and (2) a first fluid coil and a second fluid coil on the weighing scale, the fluid coils being in fluid communication with the fluid container so fluid flows through the fluid coils from and to the fluid container;

E) a first fluid connection conduit fluidically connecting the first fluid coil with the inlet fluid conduit; and F) a second fluid connection conduit fluidically connecting the second fluid coil with the return fluid conduit;

G) the weighing scale weighing the fluid coils with fluid contained therein to measure fluid characteristics of fluid being circulated through the fluid container.

2. A drilling fluid monitoring system comprising:

A) an inlet fluid conduit having an inlet end in fluid connection with a system being monitored and an outlet end, B) a return fluid conduit having an inlet end and an outlet end in fluid connection with the system being monitored;

C) a fluid container in fluid connection with the outlet end of the inlet fluid conduit and with the inlet end of the return fluid conduit so that fluid flows into and out of the fluid container via the inlet fluid conduit and the return fluid conduit;

D) a scale unit which includes (1) a weighing scale, and (2) a fluid coil unit on the weighing scale, the fluid coil unit comprising the fluid coils being in fluid communication with the fluid container so fluid flows through the fluid coil unit from and to the fluid container;

E) fluid connection conduits fluidically connecting the fluid coil unit with the inlet fluid conduit and with the return fluid conduit;

G) the weighing scale weighing the fluid coil unit with fluid contained therein to measure fluid characteristics of fluid being circulated through the fluid container.

* * * * *